US008905842B2

(12) United States Patent
Bainbridge et al.

(10) Patent No.: US 8,905,842 B2
(45) Date of Patent: Dec. 9, 2014

(54) SIGNAGE DISPLAY FOR AN ELECTRONIC GAMING TERMINAL

(75) Inventors: Scott C. Bainbridge, Chicago, IL (US); Paul C. Barker, Chicago, IL (US); Arturo E. Mancilla, San Francisco, CA (US)

(73) Assignee: WMS Gaming Inc., Waukegan, IL (US)

( * ) Notice: Subject to any disclaimer, the term of this patent is extended or adjusted under 35 U.S.C. 154(b) by 335 days.

(21) Appl. No.: 13/101,084

(22) Filed: May 4, 2011

(65) Prior Publication Data

US 2012/0283012 A1 Nov. 8, 2012

(51) Int. Cl.
*A63F 9/00* (2006.01)
*G07F 17/32* (2006.01)

(52) U.S. Cl.
CPC ..... *G07F 17/3216* (2013.01); *G07F 17/3211* (2013.01)
USPC ..... 463/30; 463/20; 463/46

(58) Field of Classification Search
USPC ..... 463/20
See application file for complete search history.

(56) References Cited

U.S. PATENT DOCUMENTS

| | | | | |
|---|---|---|---|---|
| 7,494,418 | B2 * | 2/2009 | Rifkin et al. | 463/46 |
| 7,775,888 | B2 * | 8/2010 | Wudtke | 463/46 |
| 7,780,534 | B2 | 8/2010 | Wudtke | |
| 7,833,094 | B2 * | 11/2010 | Englman et al. | 463/25 |
| 7,892,098 | B2 * | 2/2011 | Nguyen et al. | 463/46 |
| 7,896,734 | B2 * | 3/2011 | Kaminkow et al. | 463/16 |
| 7,927,218 | B2 | 4/2011 | Kopera et al. | |
| 8,057,308 | B2 * | 11/2011 | Kaminkow et al. | 463/46 |
| 8,172,669 | B2 * | 5/2012 | Barker et al. | 463/20 |
| 8,172,688 | B2 * | 5/2012 | Cole | 463/46 |
| 8,187,089 | B2 * | 5/2012 | Englman et al. | 463/25 |
| 2004/0248644 | A1 * | 12/2004 | Seelig et al. | 463/20 |
| 2005/0215325 | A1 * | 9/2005 | Nguyen et al. | 463/46 |
| 2006/0009283 | A1 * | 1/2006 | Englman et al. | 463/29 |
| 2006/0281558 | A1 * | 12/2006 | Rifkin et al. | 463/46 |
| 2007/0077984 | A1 * | 4/2007 | Aida et al. | 463/20 |
| 2007/0167217 | A1 * | 7/2007 | Kaminkow et al. | 463/20 |
| 2008/0108412 | A1 * | 5/2008 | Snow et al. | 463/20 |
| 2008/0200233 | A1 * | 8/2008 | Aida | 463/20 |
| 2008/0265503 | A1 | 10/2008 | Wudtke | |
| 2008/0268944 | A1 | 10/2008 | Wudtke | |
| 2009/0036198 | A1 | 2/2009 | Kopera et al. | |
| 2009/0045554 | A1 | 2/2009 | Myers | |
| 2009/0048012 | A1 * | 2/2009 | Patel et al. | 463/20 |
| 2009/0191942 | A1 * | 7/2009 | Bennett | 463/20 |
| 2009/0253485 | A1 * | 10/2009 | Nagano | 463/20 |

(Continued)

FOREIGN PATENT DOCUMENTS

| | | | | |
|---|---|---|---|---|
| WO | WO 2008/143781 | A1 * | 11/2008 | A63F 9/24 |

*Primary Examiner* — Seng H Lim
(74) *Attorney, Agent, or Firm* — Nixon Peabody LLP

(57) ABSTRACT

Gaming terminals, gaming systems, signage displays, and supporting structures therefore are presented herein. A gaming terminal for playing a wagering game is disclosed. The gaming terminal includes a base cabinet, an input device for receiving wagers to play the wagering game, and a terminal display for displaying information related to the wagering game. A supporting structure for supporting a signage display immediately above the base cabinet of the gaming terminal is disclosed. The supporting structure and the signage display are each free of any physical attachment to the gaming terminal. The signage display houses a display device for displaying information related to the wagering game. The supporting structure can optionally incorporate a universal mounting apparatus for removably attaching the signage display to the supporting structure, and provide for rapidly re-arranging the signage displays associated with various gaming terminals.

26 Claims, 9 Drawing Sheets

(56) References Cited

U.S. PATENT DOCUMENTS

| | | | | |
|---|---|---|---|---|
| 2009/0253486 | A1* | 10/2009 | Nagano | 463/20 |
| 2009/0318216 | A1* | 12/2009 | Tsukabe | 463/20 |
| 2009/0325668 | A1* | 12/2009 | Kelly et al. | 463/20 |
| 2009/0325669 | A1* | 12/2009 | Kelly et al. | 463/20 |
| 2010/0227667 | A1* | 9/2010 | Englman et al. | 463/20 |
| 2010/0248808 | A1* | 9/2010 | Barker et al. | 463/20 |
| 2011/0070940 | A1* | 3/2011 | Jaffe et al. | 463/20 |
| 2011/0070948 | A1* | 3/2011 | Bainbridge et al. | 463/30 |
| 2011/0201431 | A1* | 8/2011 | Meyer et al. | 463/46 |
| 2011/0207530 | A1* | 8/2011 | Chudek et al. | 463/30 |

* cited by examiner

SIGNAGE DISPLAY FOR AN ELECTRONIC GAMING TERMINAL

COPYRIGHT

A portion of the disclosure of this patent document contains materials subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present disclosure relates generally to gaming terminals and gaming systems for playing wagering games, and more particularly to supporting structures for mounting displays associated with gaming terminals and gaming systems.

BACKGROUND

Gaming machines, such as slot machines, video poker machines, and the like, have been a cornerstone of the gaming industry for several years. Generally, the popularity of such machines with players is dependent on the likelihood (or perceived likelihood) of winning money at the machine, as well as the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators therefore strive to employ the most entertaining and exciting machines, features, and enhancements available because such machines, features, and enhancements attract frequent play and, hence, increase profitability to the operator.

Many gaming machines include a variety of visual attractions and displays, such as models, signs, and other forms of information. These items typically include fixed permanently-printed glass, video displays, artwork, models, and/or marquees. In many gaming regions, industry regulations require each gaming terminal to include top-box mounted lighting and signage that indicate, for example, the class of machine, when the machine is of out of funds, when the machine is malfunctioning, etc. Historically, each gaming machine was limited to a single game with a dedicated top box display and top-box mounted flat-screen display or marquee assembly. To alter game offerings, casino operators or contracted technicians were therefore required to replace the entire gaming machine or the entire top-box mounted display and/or marquee assembly. The replacement process is costly, time consuming, and counter-productive to maintaining pace with the continuously changing gambling industry.

In response, many gaming machine manufacturers, especially those that produce video-based gaming machines, have developed a basic gaming terminal (e.g., one that is universal to a variety of game offerings) that allows multiple games to be presented on the same machine, allowing easy conversion to a new game. For instance, if a casino operator decides that a certain video reel slot game, using a particular molded marquee, has reached the end of its useful playing life on the casino floor, the operator contacts the manufacturer and requests a conversion of the gaming machine to a newer, perhaps more popular game. The conversion of the video-based wagering game is a simple task, merely requiring a change of software and perhaps surface artwork.

Any such change to the gaming machine and components physically connected to the gaming machine may also require additional regulatory approval. However, in contrast to top-box mounted displays, signage that is not attached to the gaming machine is typically considered a decorative aspect of the gaming environment and does not generally require approval by regulatory authorities.

In converting the gaming machine to a new game, previously employed marquees and display devices typically require removal and modification or replacement. There are also instances where a cabinet mounted display device simply needs to be removed for replacement or repair. This process can be time-consuming, cumbersome, expensive, and can result in damage to the display device or the gaming terminal. In many cases, replacing a cabinet-mounted display or marquee typically necessitates at least two service technicians. Time and labor costs are compounded by the complexity in electrically disconnecting and physically dismounting and managing the bulk and weight of the assembly, and subsequently mounting and connecting the new assembly. Often times, the technician is required to run electrical cabling from the assembly, down through an opening in the crown and through the top box to the base cabinet. This often requires opening and dismantling a significant portion of the gaming terminal to complete the electrical connections. Furthermore, some top-box mounted displays draw a large amount of current, perhaps as much as 15 amperes, and electrical cables carrying the required current must be passed through the cabinet of the gaming machine, which creates an increased need for RFI shielding within the gaming machine and introduces a potentially hazardous increased risk of electrostatic discharge.

Therefore, casino operators generally lack modular components for re-arranging configurations of gaming machines and associated top-box mounted displays and other displays to respond to changing interests and demands of their customers. In addition, casino operators and manufacturers of gaming machines may be limited in introducing new or modified displays associated with gaming machines by the need to seek regulatory approval for any such displays that are attached to the gaming machines.

SUMMARY

Aspects of the present disclosure provide a gaming system including a gaming terminal, a supporting structure, and a signage display. The gaming terminal is for playing a wagering game. The gaming terminal including a base cabinet, an input device for receiving inputs from a player to play the wagering game, and a terminal display for displaying information related to the wagering game. The supporting structure is adjacent to the gaming terminal. The signage display includes a display device for displaying information related to the wagering game. The signage display is mounted on the supporting structure such that the display device is immediately above the base cabinet of the gaming terminal. The signage display and the supporting structure are free of physical attachment to the gaming terminal.

Aspects of the present disclosure further provide a gaming system including a first gaming terminal, a second gaming terminal, a signage display, and a supporting structure. The first gaming terminal is for playing a first wagering game. The first gaming terminal includes a first base cabinet, a first input device for receiving inputs to play the first wagering game, and a first terminal display for displaying information related to the first wagering game. The second gaming terminal is for playing a second wagering game. The second gaming terminal includes a second base cabinet, a second input device for receiving inputs to play the second wagering game, and a second terminal display for displaying information related to the second wagering game. The signage display is free of physical attachment to the first or the second gaming terminals. The signage display includes a first display device for displaying, on a first side of the signage display, first information related to the first wagering game played on the first gaming terminal. The signage display also includes a second display device for displaying, on a second side of the signage display opposite the first side, second information related to the second wagering game played on the second gaming terminal. The supporting structure is adapted for being positioned between the first and the second gaming terminals for supporting the signage display such that the first display device is immediately above the first base cabinet of the first gaming terminal and the second display device is immediately above the second base cabinet of the second gaming terminal. The supporting structure is free of physical attachment to the first or the second gaming terminals.

Aspects of the present disclosure further provide a gaming system including a first gaming terminal, a second gaming terminal, a signage display, and a supporting structure. The first gaming terminal is for playing a first wagering game. The first gaming terminal includes a first base cabinet, a first input device for receiving inputs to play the first wagering game, and a first terminal display for displaying information related to the first wagering game. The second gaming terminal is for playing a second wagering game. The second gaming terminal includes a second base cabinet, a second input device for receiving inputs to play the second wagering game, and a second terminal display for displaying information related to the second wagering game. The first gaming terminal and the second gaming terminal are positioned such that a back side of the first base cabinet of the first gaming terminal is facing a back side of the second base cabinet of the second gaming terminal. The signage display includes a first display device for displaying, on a first side of the signage display, first information related to the first wagering game played on the first gaming terminal. The signage display also includes a second display device for displaying, on a second side of the signage display opposite the first side, second information related to the second wagering game played on the second gaming terminal. The supporting structure is for supporting the signage display such that the first display device is immediately above the first base cabinet of the first gaming terminal and the second display device is immediately above the second base cabinet of the second gaming terminal. The supporting structure is free of physical attachment to the first or the second gaming terminals. The supporting structure is adapted for being positioned between the back side of the first base cabinet and the back side of the second base cabinet.

Aspects of the present disclosure further provide a signage display system associated with a gaming terminal for playing a wagering game. The signage display system includes a signage display having a housing and a display device housed within the housing. The display device is adapted for displaying information related to the wagering game. The signage display system also includes a supporting structure for supporting the signage display above the gaming terminal. The supporting structure has an enclosure that substantially encloses the supporting structure. The signage display system also includes a mounting assembly for mounting the signage display to the supporting structure such that the signage display is immediately above the base cabinet of the gaming terminal. The mounting assembly pivotably supports the signage display such that the signage display can selectively swing from a first position for operation to a second position for maintenance. The signage display, the supporting structure, and the mounting assembly are free of physical attachment to the gaming terminal.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
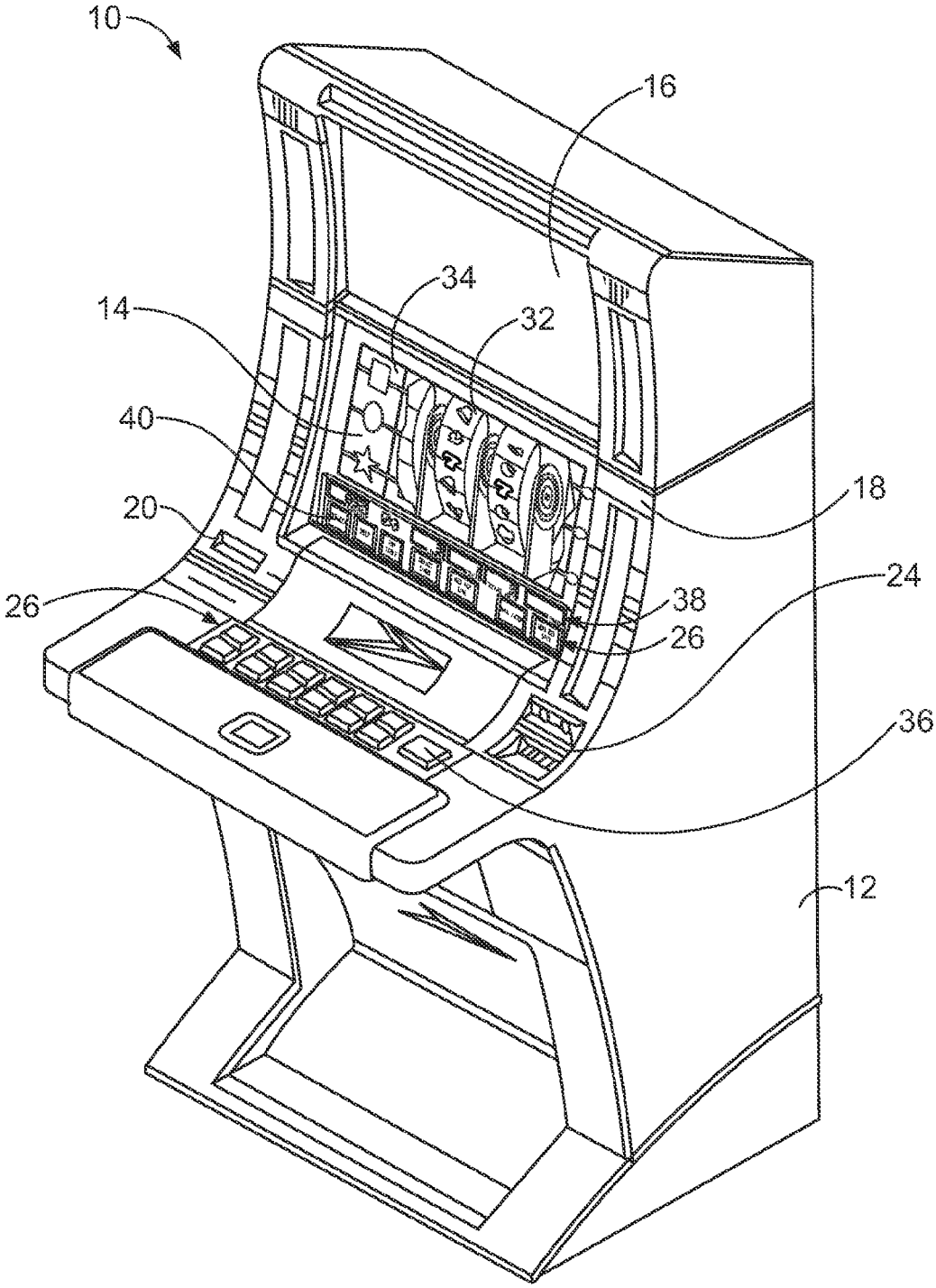
FIG. 1 PRIOR ART
FIG. 1 is a perspective-view illustration of an exemplary free-standing gaming terminal according to aspects of the present disclosure.

While the aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there are shown in the drawings and will herein be described in detail representative embodiments with the understanding that the present disclosure is to be considered as an exemplification of the various aspects and principles of the invention, and is not intended to limit the broad aspect of the invention to the embodiments illustrated. To that extent, elements and limitations that are disclosed, for example, in the Abstract, Summary, and Detailed Description of the Embodiments sections, but not explicitly set forth in the claims, should not be incorporated into the claims, singly or collectively, by implication, inference or otherwise.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 can be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area (or "terminal display") 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor (not shown), one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
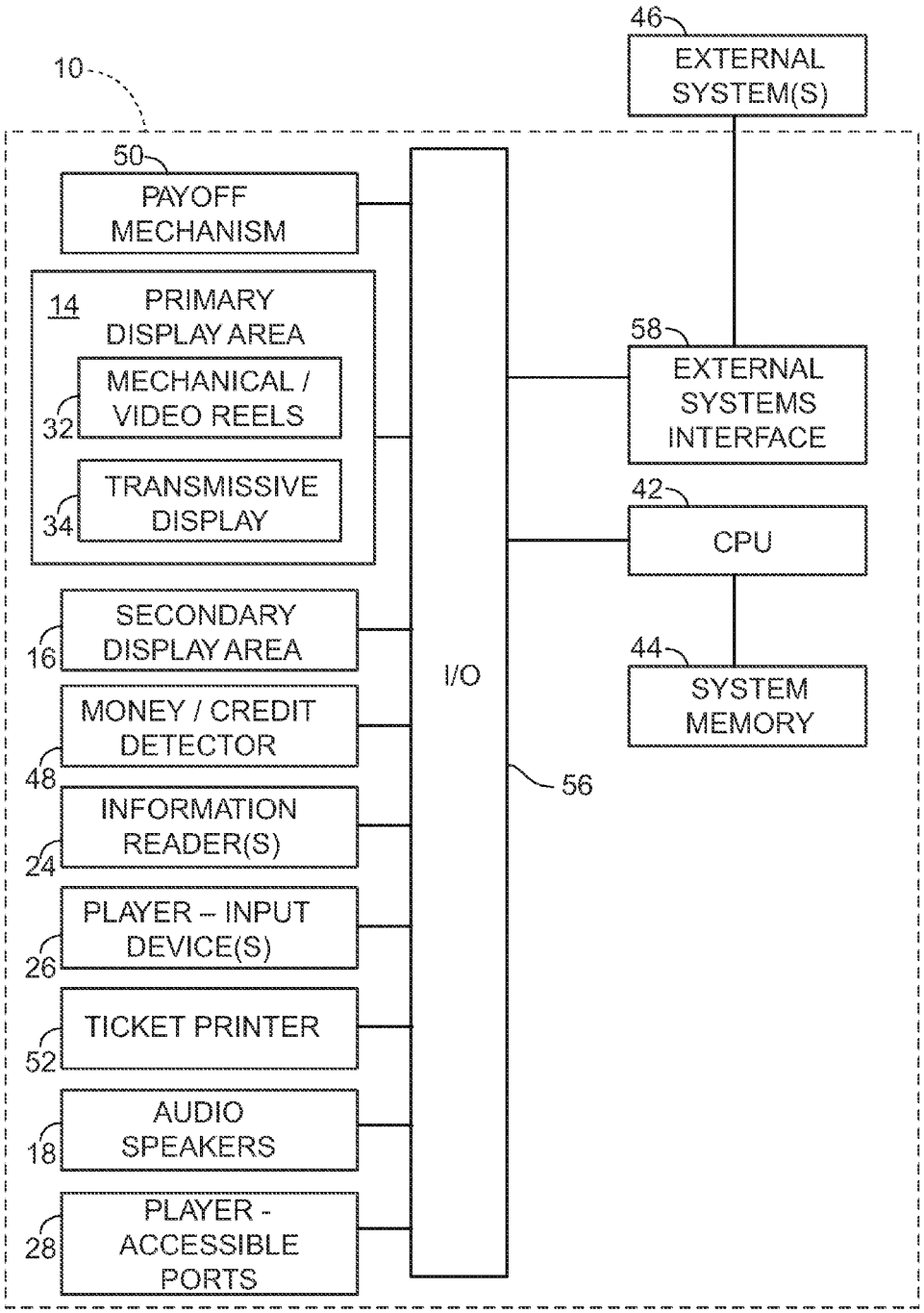
FIG. 2 PRIOR ART
FIG. 2 is a schematic diagram of an exemplary gaming system according to aspects of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor (not shown), or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device (s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+front-side bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
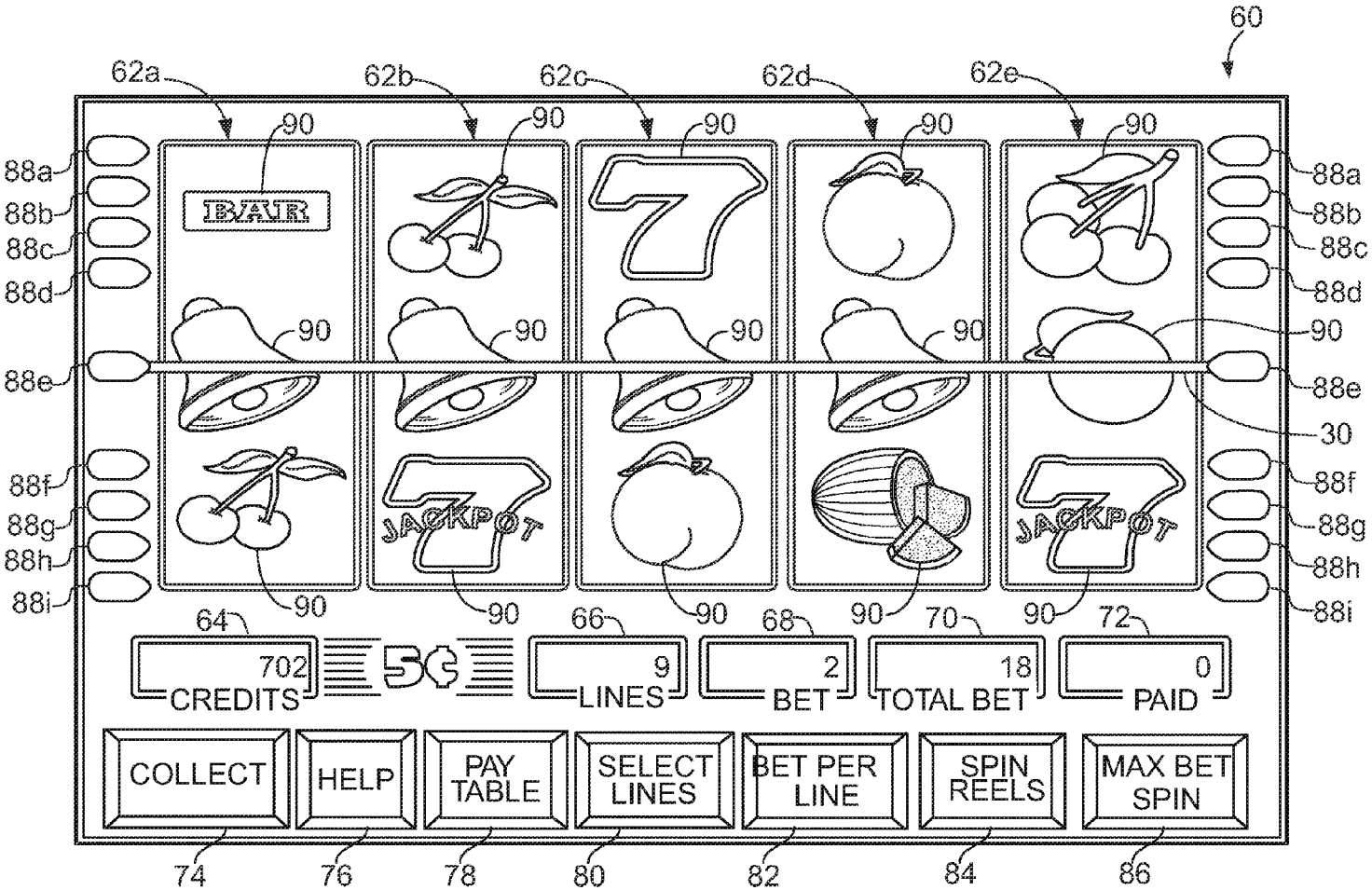
FIG. 3 PRIOR ART
FIG. 3 is a screen shot of a basic-game screen from an exemplary wagering game that can be played, for example, on the gaming terminal of FIG. 1 or the gaming system of FIG. 2.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 4:
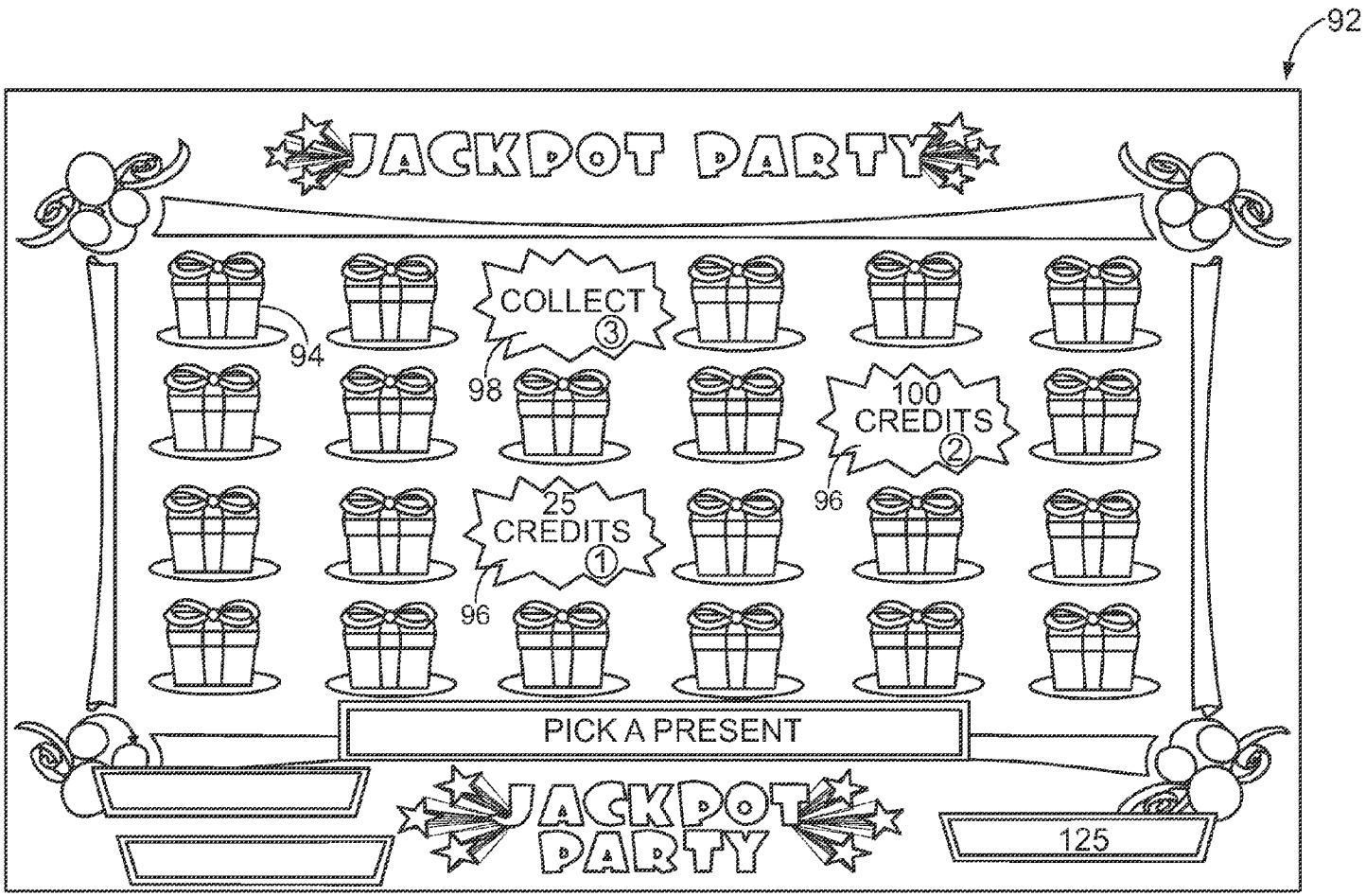
FIG.4 PRIOR ART
FIG. 4 is a screen shot of a secondary-game or bonus-game screen from an exemplary wagering game that can be played, for example, on the gaming terminal of FIG. 1 or the gaming system of FIG. 2.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5B:
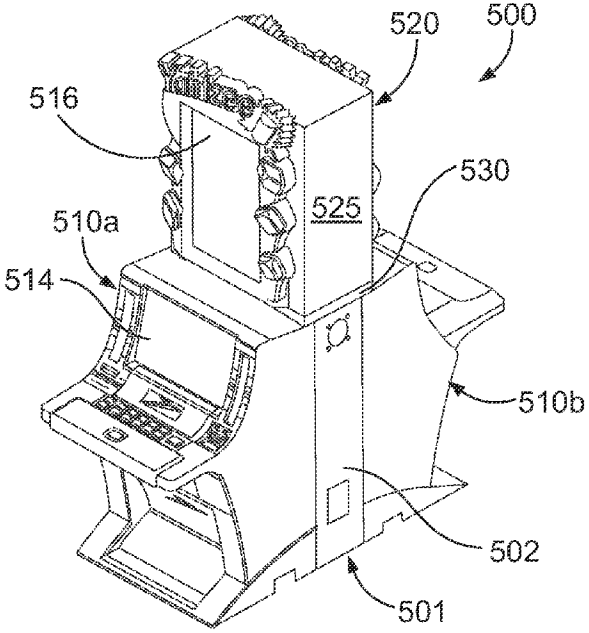
FIG. 5B provides an assembled view of the gaming system shown in FIG. 5A.
Figure 5A:
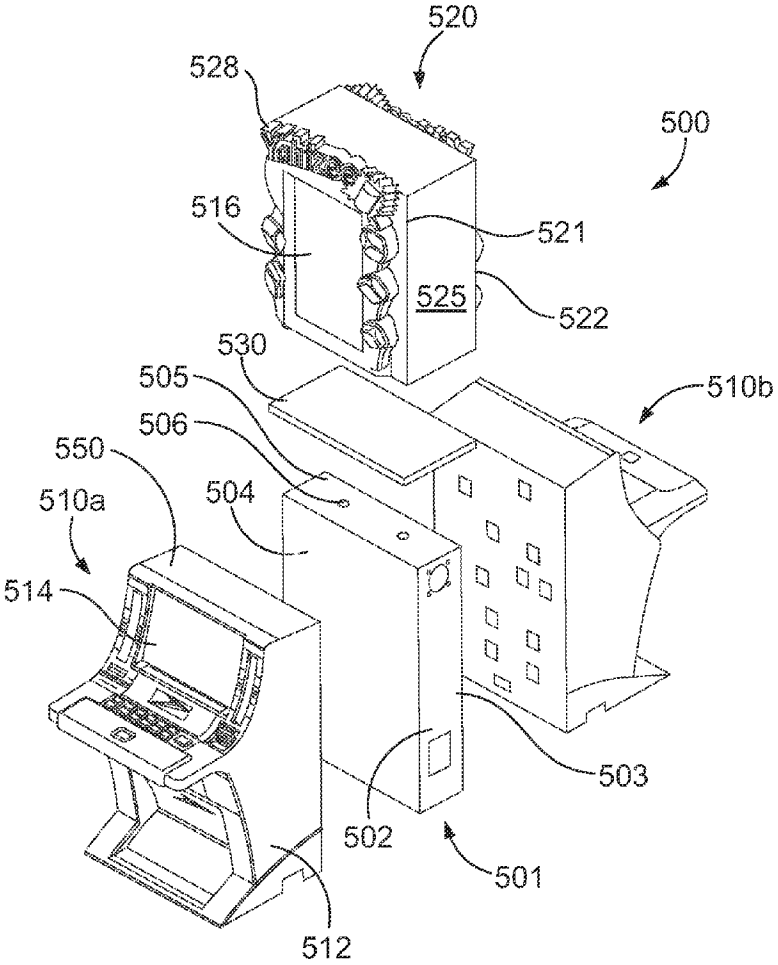
FIG. 5A is a disassembled perspective view of an exemplary gaming system with gaming terminals positioned back to back and a dual-sided signage display.

Referring now to FIG. 5A, a disassembled perspective view of an exemplary gaming system 500 with gaming terminals 510*a*, 510*b* positioned back to back and a dual-sided signage display 520 is provided. FIG. 5B provides an assembled view of the gaming system 500 shown in FIG. 5A. The gaming terminals 510*a*, 510*b* in FIGS. 5A and 5B are similar to the gaming system 10 in some respects, but the gaming terminals 510*a*, 510*b* are not physically attached or connected to a top box having the secondary display area 16 (see FIG. 1). Generally, the first gaming terminal 510*a* and the second gaming terminal 510*b* each provide one or more input device(s) for a player to input information for playing a wagering game on the respective gaming terminals 510*a*, 510*b*. The gaming terminals 510*a*, 510*b* are each enclosed by a cabinet (or "base cabinet") 512 having a top surface 550. The cabinet 512 houses and/or supports internal components associated with the gaming terminals 510*a*, 510*b*. Each of the gaming terminals 510*a*, 510*b* also include a terminal display 514 (similar to the primary display area 14 of FIG. 1) for displaying information related to the wagering games played on the respective gaming terminals 510*a*, 510*b*. Similar to the gaming terminal 10 described in connection with FIGS. 1-4, the gaming terminals 510*a*, 510*b* may provide a variety of wagering games and are not limited to a particular type or category of wagering game.

In the gaming system 500, a supporting structure (or "stage") 501 is positioned between the gaming terminals

510*a*, 510*b*. The supporting structure 501 supports the dual-sided signage display 520 above the gaming terminals 510*a*, 510*b*. The dual-sided signage display 520 has opposing sides described for convenience as a front side 521 and a rear side 522. Although the descriptors "front side" and "rear side" are chosen for convenience according to the perspective view of FIGS. 5A and 5B, the choice of descriptors does not indicate a preferred orientation of the gaming system 500 as "first side" and "second side" could also be used. The signage display 520 is substantially enclosed by a housing 525 that houses and/or supports the internal components of the signage display 520. A first display device 516 is mounted on or in the housing 525 and is visible from the front side 521 of the signage display 520. A second display device (not viewable in the perspective view of FIGS. 5A and 5B) is also mounted on or in the housing 525 and is visible from the rear side 522 of the signage display 520.

The first display device 516 can display information related to a wagering game played on the first gaming terminal 510*a*. The second display device (not shown) can display information related to a wagering game played on the second gaming terminal 510*b*. The first display device 516 (and second display device) is mounted on or in the housing 525 such that display screens of the display devices are visible from the exterior of the housing 525, but cables and wires delivering power and video signals to the display devices are enclosed within the housing 525. The housing 525 also provides a surface for mounting static visual features 528 to the signage display 520. The static visual features 528 can be three-dimensional graphics related to the wagering game provided on the gaming terminals 510*a*, 510*b*, such as the static visual features 528 shown in FIGS. 5A and 5B. Implementations may alternatively and/or additionally include signs, lights, and other visual features on the housing 525 that relate to the wagering games played on the gaming terminals 510*a*, 510*b*.

The supporting structure 501, which is described in more detail in connection with FIGS. 6A and 6B, includes an enclosure 502 to substantially enclose the supporting structure 501 and to enclose and/or support any associated internal components (such as the components 631, 632, 633 and associated electrical wires 620 shown in FIGS. 6A and 6B). The enclosure 502 has a first side wall 503, a second side wall 504, and a top surface 505. The first side wall 503 and the second side wall 504 are laterally opposing sides of the enclosure 502 and the distance between the side walls 503, 504 can define a width dimension of the enclosure 502. The enclosure 502 need not be entirely solid, and generally may include various ports, removable panels, and/or modular openings for allowing air circulation (e.g. for providing a cooling function) and for allowing cables and wires to be passed through. In particular, the enclosure 502 can have one or more ports 506 in the top surface 505 for allowing electrical cables to pass from the supporting structure 501 to the dual-sided signage display 520 through an aligned port (not shown) in a bottom portion of the dual-sided signage display 520. The enclosure 502 may incorporate tamper-proof aspects on portions of the enclosure 502 that are exposed to the public to prevent snooping or tampering with any internal components housed within the enclosure 502. For example, in a configuration similar to the assembled view of the system 500 shown in FIG. 5B, the first sidewall 503 can be made tamper-proof such that the enclosure 502 is not readily breached through the first sidewall 503 without an authenticating device such as, for example, a key to open a lock, etc.

In one implementation, the supporting structure 501 has a height dimension very close to a height dimension of the cabinets 512 of the gaming terminals 510*a*, 510*b* such that the top surface 505 of the enclosure 502 aligns with, and is substantially co-planar with, the top surface 550 of the cabinets 512 of the gaming terminals 510*a*, 510*b*. In addition, the enclosure 502 can have a width dimension such that the first side wall 503 and the second side wall 504 are substantially aligned with, and co-planar with, sides of the cabinet 512 of the gaming terminals 510*a*, 510*b*. In a configuration where the dimensions of the enclosure 502 are such that the side walls 503, 504 are co-planar with the cabinet 512, the enclosure 502 of the supporting structure 501 can blend naturally with the cabinets 512 of the gaming terminals 510*a*, 510*b* and may appear to be a portion thereof. For example in the assembled view of FIG. 5B, where the gaming terminals 510*a*, 510*b* abut the supporting structure 501, the enclosure 502 of the supporting structure 501 aligns with the cabinets 512 of the gaming terminals 510*a*, 510*b* to provide a flush side surface of the gaming system 500. Additionally, a depth dimension of the supporting structure 501 may be chosen so as to allow for enough space to adequately house, support, and/or cool any internal components within the enclose 502 of the supporting structure 501. Additionally, the depth dimension is chosen to allow adequate structural stability to independently support the signage display 520 without any physical attachment to the gaming terminals 510*a*, 510*b*. In one implementation, the depth dimension may be selected to be the minimum satisfactory dimension to achieve the above-described goals in order to minimize floor space required by the supporting structure 501 in a gaming venue, such as a casino.

The dual-sided signage display 520 may have a depth dimension (measured in the direction perpendicular to the surface of the display device 516) greater than the depth dimension of the supporting structure 501 such that the dual-sided signage display 520 partially over-hangs the first gaming terminal 510*a* and/or the second gaming terminal 510*b*. In addition, the dual-sided signage display 520 may partially rest upon (i.e. contact) the top surface(s) 550 of the cabinets 512 of the gaming terminals 510*a*, 510*b*. However, the supporting structure 510 is free of any physical attachment to the gaming terminals 510*a*, 510*b*. That is, the supporting structure 501 is not attached to either the first gaming terminal 510*a* or the second gaming terminal 510*b*.

When the signage display 520 is supported by the supporting structure 501, the signage display 520 advantageously appears to be a top box for the base cabinet 512 of the gaming terminal (e.g. 510*a*). For example, the signage display 520 can optionally abut or nearly abut the top surface 550 of the base cabinet 512 such that the signage display 520 is perceived to be a top box for the base cabinet 512. In an implementation of the present disclosure, the vertical distance between the signage display 520 and the top surface 550 of the base cabinet 512 is sufficiently small to allow the signage display 520 to appear as a top box for the base cabinet 512. Furthermore, the vertical distance can be sufficiently small to create an illusion of physical connection between the signage display 520 and the base cabinet 512. In an example implementation, the signage display 520 is disposed within 4 inches of the top surface 550 of the base cabinet 512, and is preferably disposed within a range of 0.25 to 0.5 inches of the top surface 550.

The supporting structure 501 can optionally be anchored in the floor to enhance its ability to resist tipping against transverse or off-center forces exerted on any combination of the supporting structure 501 and the dual-sided signage display 520. Generally, while the dual-sided signage display 520 and the supporting structure 501 each lack any physical connection to the gaming terminals 510*a*, 510*b*, either the supporting structure 501 or the dual-sided signage display 520 can optionally abut, overhang, and/or rest upon either or both of the gaming terminals 510*a*, 510*b*.

The signage display 520 may be mounted on a separate deck 530 to provide an attachment to the supporting structure 501. The deck 530 can be a rectangular rigid portion formed from metal, plastic, or another suitable material. The deck 530 can be attachable to the supporting structure 501, and to the dual-sided signage display 520. The deck 530 can optionally have width and length dimensions slightly smaller than a bottom portion of the dual-sided signage display 520 such that the deck 530 can be coupled to the bottom of the dual-sided signage display 520 without being visible once the gaming system 500 is assembled as in FIG. 5B. The deck 530 may have length and width dimensions different than the top portion of the supporting structure 510 or have a trapezoidal cross-sectional shape. The deck 530 generally allows for transferring the load of the dual-sided signage display 520 to the supporting structure 501. In addition, the deck 530 can optionally incorporate one or more universal mounting assemblies for removably coupling to either the supporting assembly 501 or the dual-sided signage display 520. Universal mounting assemblies can allow for the dual-sided signage display 520 to be readily changed or swapped according to changes in the configuration of the gaming terminals 510*a*, 510*b* without removing or otherwise changing the supporting structure 501.

In an exemplary operation of the configuration shown in FIGS. 5A and 5B, the first gaming terminal 510*a* and the second gaming terminal 510*b* each provide a wagering game that is played by a player providing inputs, such as, for example, wagers. The wagering games played on the gaming terminals 510*a*, 510*b* can be similar to one another, can be different from one another, can have inter-related features such as progressive awards or bonus awards, or can be entirely unrelated wagering games. The first display 516 on the signage display 520 provides information for the first gaming terminal 510*a*, while the second display on the signage display 520 provides information for the second gaming terminal 510*b*.

In alternative configurations, the signage display 520 can also include additional display devices, which can be either dynamic or static, and can be visible from side walls of the housing 525. The additional display devices can optionally be related to the wagering games offered on the gaming terminals 510*a*, 510*b*, or can be related to advertisements, entertainment, and the like.

Figure 6A:
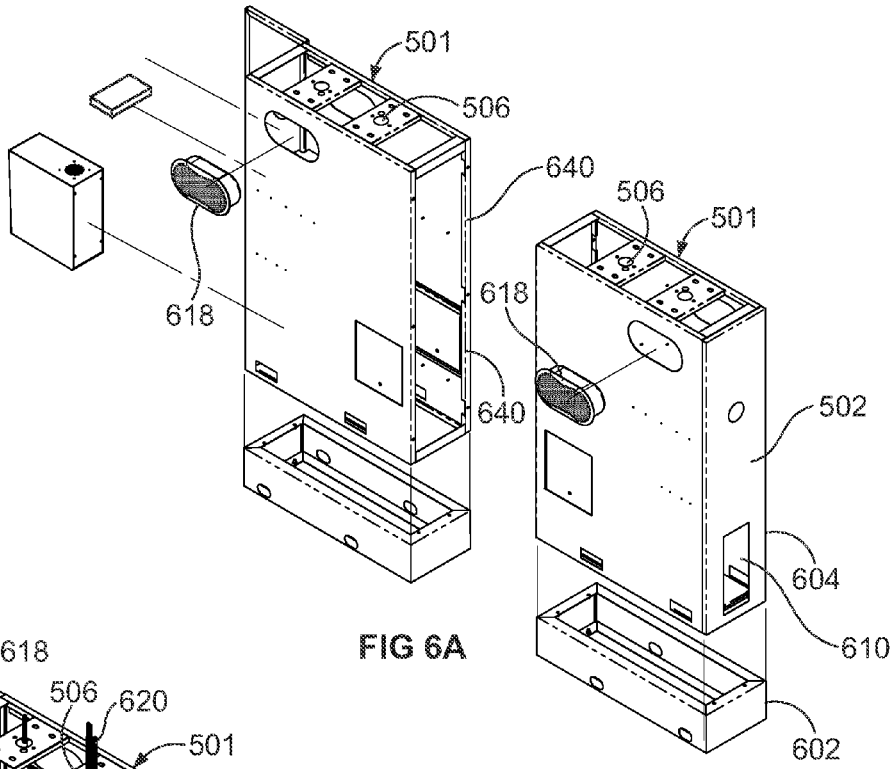
FIG. 6A provides a disassembled view of a pair of supporting structures housing electrical components and speakers.

FIG. 6A provides a disassembled view of a pair of supporting structures 501 housing electrical components 631-633 and speakers 618. FIG. 6B provides a cut-away view of the assembled pair of supporting structures 501 showing internal components and wiring. In the implementation of the supporting structures (or "stages") 501 shown in FIG. 6A, the supporting structure is shown having a bottom portion 602 and a top portion 604. The bottom portion(s) 602 and top portion(s) 604 can be made of metal, wood, plastic, or another rigid material. The portions 602, 604 can be securely attached or fastened together by mating modular components that snap, clip, or slide together similar to the modular components 640, or can be securely attached together using screws, bolts, adhesive(s), or the like.

Figure 6B:
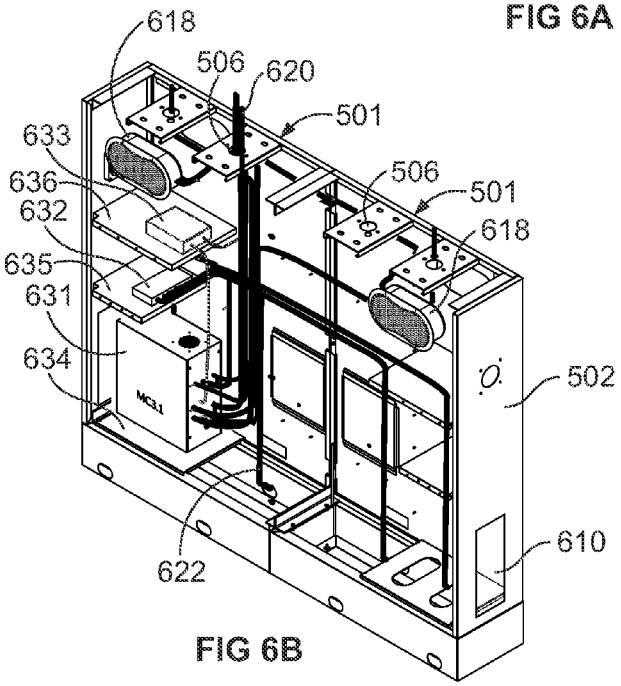
FIG. 6B provides a cut-away view of the assembled pair of supporting structures showing internal components and wiring.

With reference to FIG. 6B, the supporting structure 501 has internal platforms 634, 635, 636 for supporting one or more internal electrical components 631, 632, 633 and their associated electrical cables 620. In the example configuration illustrated in FIG. 6B, a media controller 631 is supported by the first internal platform 634, a network controller 632 is supported by a second internal platform 635, and a sound board controller 633 is supported by a third internal platform 636. The media controller 631 can include a processor, a memory, and one or more communication terminals for receiving information. The media controller 631 and/or additional electrical components such as the sound board controller 633 generate media signals indicative of visual or audio effects to be conveyed to a display device within the signage display supported by the supporting structure 501 and to the speakers 618. In addition, the supporting structure 501 can optionally house a controller for determining bonus features of the gaming terminal 510*a* or of a plurality of gaming terminals (e.g. the gaming terminals 510*a*, 510*b*).

Implementations where the media content delivered to the signage display supported above the supporting structure 501 is generated by a remote server may be more inclined to utilize the media controller 631 housed within the supporting structure 501. The media controller 631 can receive network signals from a remote server (e.g. the external system 46 of FIG. 2) that provides data indicative of the media content to be delivered to the signage display and its associated display device (such as the display device 516 shown in FIG. 5A or the display device 716 shown in FIG. 7). The media controller 631 analyzes the received data and generates A/V signals that are then sent to the display device 516 and/or speakers (such as the speakers 618 or speakers mounted on or in the housing 525). Furthermore, as shown in FIG. 6B, a plurality of supporting structures 501 (e.g. two) may be served by a single media controller (e.g. the media controller 631) that provides a plurality of video output signals to associated display devices within signage displays supported by the plurality of supporting structures.

As mentioned above, the supporting structures 501 shown in FIGS. 6A and 6B include the ports 506 for allowing electrical cables 620 to be passed through. Alternatively or additionally to the ports 506, the supporting structures 501 may include one or more electrical connectors or terminals near the top of the supporting structure 501 that are accessible from the exterior of the enclosure 502 such that a mating connector from a signage display (such as the dual-sided signage display 520 or the signage display 720 shown in FIG. 7) can be connected to the electrical connectors or terminals rather than passing electrical cables through the ports 506. Implementations utilizing externally accessible electrical connectors or terminals may allow for more rapid changing or swapping of signage displays as there is a reduced time requirement to fish electrical cables through the supporting structures 501 or the signage displays in such a configuration. In addition, such configurations can allow for changing signage displays without opening the housing 502 of the supporting structure 501.

The electrical cables 620 include media cables such as video cables (e.g., HDMI, DVI, VGA, etc.) for conveying video signals to a display device (e.g. 516 of FIG. 5A) within the signage display (e.g. 520 of FIG. 5A) supported above the supporting structure 501. The A/V signals may be carried by separate electrical cables or by common cables (such as in an HDMI cable). The A/V signals may be supplied by electronic components within the gaming terminal 510*a*, by a media controller (such as the media controller 631) within the supporting structure, or by a combination. The electrical cables 620 can also include audio speaker cables for delivering audio signals to associated speakers, such as the speakers 618 mounted on or in the enclosure 502, or speakers (not shown) housed on or in the housing 525 of the signage display 520. The electrical cables 620 passed through the port 506 also generally include a power supply cable 622 for powering electronic components in the signage display supported by the supporting structure 501. The power supply cable 622 can be a typical three-terminal AC power supply cable suitable for powering a display device such as a plasma, LCD, or LED display.

Furthermore, the enclosure 502 of the supporting structure 501 can provide an enclosed region for power cables 622 delivering a power supply to the display device to pass through. In one implementation, the power supply requirements of the display device and any other associated electronic components in the signage display may be as high as 15 amperes. In such an implementation, each supporting structure may receive power from a separate 20 ampere rated power supply circuit. By allowing the power cable 622 to pass through the supporting structure 501, power supply cables are kept out of the cabinet 512 of the gaming terminal 510*a*. By keeping the power cables out of the cabinet 512 the risk of electrical interference and electrostatic discharge is advantageously reduced, both for the players and for the electronic components within the cabinet 512, such as, for example, an RNG.

The speakers 618 are housed within the enclosure 502 of the supporting structure 501 and can provide sounds related to a wagering game being played on a gaming terminal associated with the supporting structure 501. In one implementation, supporting structures 501 having speakers 618 have a height dimension sufficiently large relative to a height of an associated gaming terminal such that the speakers 618 are not covered by the associated gaming terminal when the supporting structure 501 is positioned adjacent the back side of the gaming terminal with the speakers 618 facing the gaming terminal.

The supporting structure 501 includes a modular removable panel 610. The modular removable panel 610 can be removed in order to provide airflow for controlling the temperature within the supporting structure 501. One or more fans (e.g. case fans) can be included within the enclosure 502 of the supporting structure 501 to moderate the temperature within the enclosure 502. The modular removable panel 610 can also be removed in order to join adjacent supporting structure 501, which is what is illustrated in FIG. 6B, where both of the supporting structures 501 have a side panel removed and the two supporting structures 501 have been coupled together. To allow for efficient modular use of the supporting structures 501, some supporting structures can optionally be configured as mirror images of other supporting structures with respect to a plane bisecting the width of the supporting structure, which is what is shown in FIGS. 6A and 6B. The modular removable panel 610 can optionally be secured by a tamper-proof device for preventing unauthorized access to the interior of the enclosure 502.

Figure 8B:
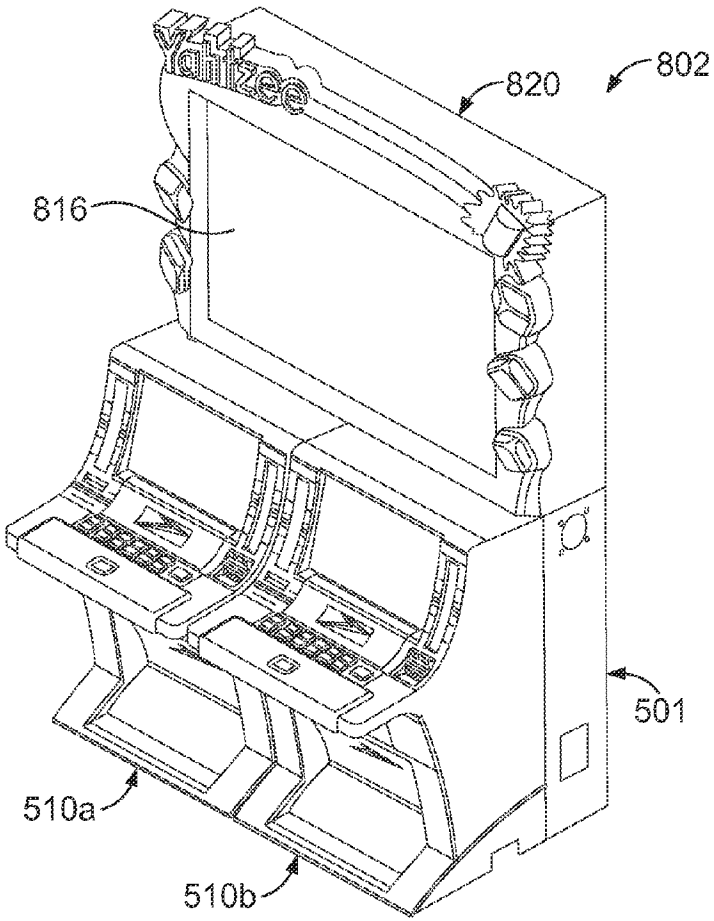
FIG. 8B is a gaming system where two gaming terminals are each associated with a supporting structure jointly supporting a single signage display.
Figure 8A:
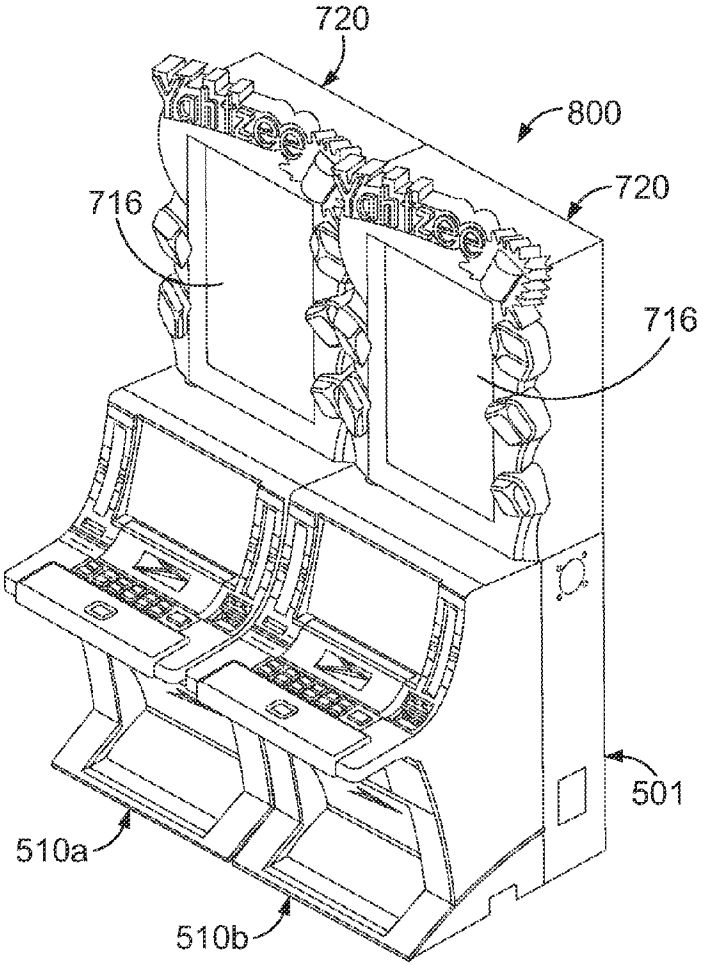
FIG. 8A provides an illustration of a gaming system having a first gaming terminal and a second gaming terminal arranged adjacent to each other (that is, arranged side to side).

By coupling together the supporting structures 501 as shown in FIG. 6B, the resulting coupled supporting structures 501 can be used to jointly support two adjacent signage displays for associated gaming terminals (as shown in FIG. 8A), or can be used to jointly support a single signage display associated with a plurality of adjacent gaming terminals (as shown in FIG. 8B).

Figure 7:
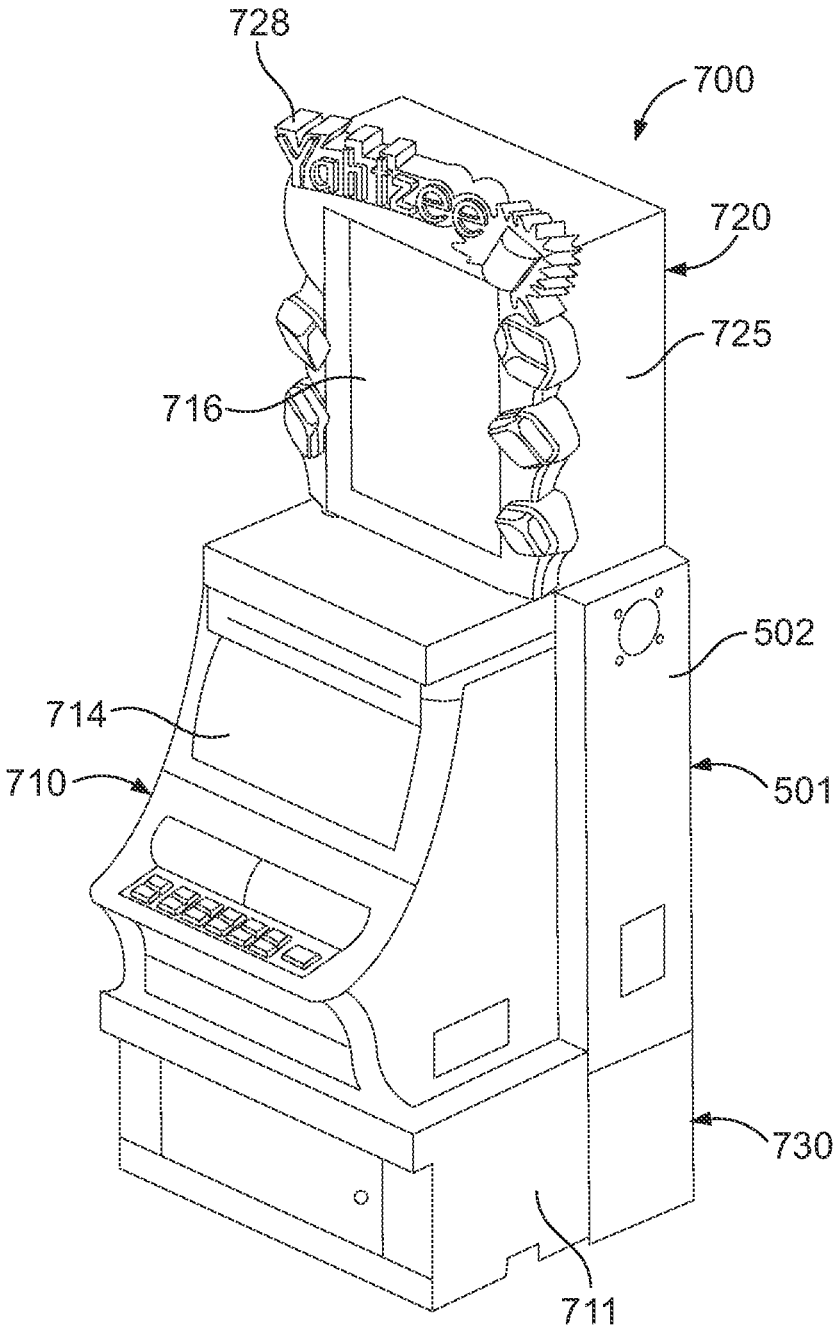
FIG. 7 illustrates a gaming system having a signage display supported above the gaming terminal.

FIG. 7 illustrates a gaming system 700 having a signage display 720 supported above the gaming terminal 710. The physical appearance of the gaming terminal 710 shown in FIG. 7 is modified from the gaming terminal 510*a* in FIGS. 5A and 5B, but the operative function of the gaming terminal 710 to provide an input device for receiving a player's inputs and allowing a player to play a wagering game is unchanged. The gaming system 700 shown in FIG. 7 also includes the supporting structure 501, which supports the signage display 720 above the gaming terminal 710. The signage display 720 includes the housing 725 to house and/or support the display device 716. The signage display 720 is arranged such that the display device 516 is visible from the front of the gaming terminal 710, (e.g. the side of the gaming terminal 710 having the terminal display 714). The signage display 720 also includes the static visual features 728 (similar to the static visual features 528 described in connection with FIGS. 5A and 5B). The signage display 720 and the supporting structure 501 are free of any physical attachment to the gaming terminal 710, although portions of the signage display 720 and/or supporting structure 501 may overhang, abut, or rest upon portions of the gaming terminal 710.

The gaming system 700 shown in FIG. 7 also includes a riser 730. The riser 730 elevates the supporting structure 501, and consequently, elevates the signage display 720. The riser 730 may be formed from a rigid material such as metal, wood, or plastic, etc. The riser 730 advantageously allows for raising the supporting structure 501 associated with the gaming terminal 710 to allow for different heights of the gaming terminal 710 that can cooperate with a single supporting structure 501 through use of the riser 730. In addition, implementations utilizing the riser 730 to elevate the supporting structure 501 may be realized when the gaming terminal 710 is also elevated by an amount similar to the elevation provided by the riser 730. For example, the gaming terminal 710 can be elevated by a stand 711 to allow the gaming terminal 710 to be used by standing players versus sitting players according to the preferences of the gaming venue. In one implementation, the riser 730 may be enclosed in a manner similar to the supporting structure 501 and may have dimensions to allow exposed surfaces of the riser 730 to be co-planar with adjacent side wall surfaces of the cabinet of the gaming terminal 710 in order to give the gaming system 700 a finished, flush appearance.

Thus, the riser 730 allows for modular design of the supporting structure 501 by allowing the effective height of the supporting structure 501 to be adjusted for different applications by positioning the supporting structure on top of the riser 730. The supporting structure 501 can be securely connected to the riser 730 using, for example screws, bolts, adhesives, or by modular components that clip or snap together to allow the supporting structure 501 to be securely attached to the riser 730. In addition, the secure connection can be a removable connection to allow for rapid reconfiguration according to dynamic demand for particular configurations of the gaming system 700. The supporting structure 501, the riser 730, and the signage display 720 can be utilized as modular components that can be mixed and matched as desired to arrange a gaming system as desired. Alternatively or additionally, the system 700 may incorporate multiple risers which can themselves be connected to one another to create risers of different heights. In addition, the system 700 may also be realized with supporting structures 501 of varying heights suitable for particular applications.

Generally with reference to FIGS. 6A, 6B, and 7, the features with respect to the placement of electrical cables, the fans, electronic components such as media controllers, etc. discussed in connection with FIGS. 6A and 6B also apply to the system 700 shown in FIG. 7.

FIG. 8A provides an illustration of a gaming system 800 having a first gaming terminal 510*a* and a second gaming terminal 510*b* arranged adjacent to each other (that is, arranged side to side). Supporting structures 501 are positioned at the rear of the gaming terminals 510*a*, 510*b*, and each supports a signage display 720 having a display device 716. As previously described and illustrated in connection with FIGS. 6A and 6B, the supporting structures 501 may be snapped, clipped, or otherwise securely attached to each other when arranged side-to-side as in FIG. 8A. Additionally or alternatively, the enclosed regions of the supporting structures 501 may be fluidly connected by opening and/or removing aligned modular panels on each adjacently positioned supporting structure 501 to allow air to pass through and regulate the temperature inside the supporting structures 501. In addition, aligned modular openings or removable panels in the supporting structures can allow for electrical cables (such as power cables, networking cables, and media cables) to pass between adjacently positioned supporting structures 501.

Adjacently situated supporting structures 501 can jointly support a single signage display as shown in the gaming system 802 of FIG. 8B. The gaming system 802 is provided where two gaming terminals 510*a*, 510*b* are each associated with a supporting structure 501 jointly supporting a single signage display 820. The supporting structures 501 for each gaming terminal 510*a*, 510*b* are coupled together and jointly support a single signage display 820 that can span the width of both gaming terminals 510*a*, 510*b*, as shown in FIG. 8B. The single signage display 820 includes a display device 816 in a housing 825 of the single signage display 820. The display device 816 provides a video display of information related to the one or more wagering games played on one or both of the gaming terminals 510*a*, 510*b*. The display device 816 can be configured as a split screen to display one image on a left portion of the display device 816 and another image on a right portion of the display device 816. For example, the left portion can display information related to the wagering game played on the first gaming terminal 510*a* and the right portion can display information related to the wagering game played on the second gaming terminal 510*b* such that information pertinent to the respective gaming terminals 510*a*, 510*b* is displayed above the respective gaming terminals 510*a*, 510*b*. The display device 816 can also display one unified image including information related to the wagering games played on both gaming terminals 510*a*, 510*b*.

By coupling the adjacently positioned supporting structures 501 to each other, the supporting structures 501 are able to stably support the single signage display 820 without any physical attachment to the gaming terminals 510*a*, 510*b*. In addition, the adjacently positioned supporting structures 501 shown in FIG. 8A can jointly support the plurality of signage displays 720 attached to the supporting structure by coupling/attaching the adjacent supporting structures 501 and optionally by attaching together adjacently positioned signage displays 720.

While two gaming terminals 510*a*, 510*b* are shown in the systems 800 and 802, implementations may have more gaming terminals and associated supporting structures 501 and signage displays 720 arranged in a continuous row or arranged in clusters. The single signage display 820 in the gaming system 802 is shown as being associated with the two gaming terminals 510*a*, 510*b*, but the single signage display 820 is not so limited and may be implemented, for example, as a signage display spanning three, four, or five gaming terminals.

The various signage displays (520, 720, 820) described herein are each generally shown including a display device (516, 716, 816), and may also include speakers for delivering audio content related to the wagering game played on the gaming terminals 510*a*, 510*b*, and/or additional dynamic or static lights and visual displays. Additionally or alternatively, any speakers and/or additional lights and displays on the various signage displays (520, 720, and 820) may provide audio and/or video content related to advertising, entertainment options, etc.

Figure 9:
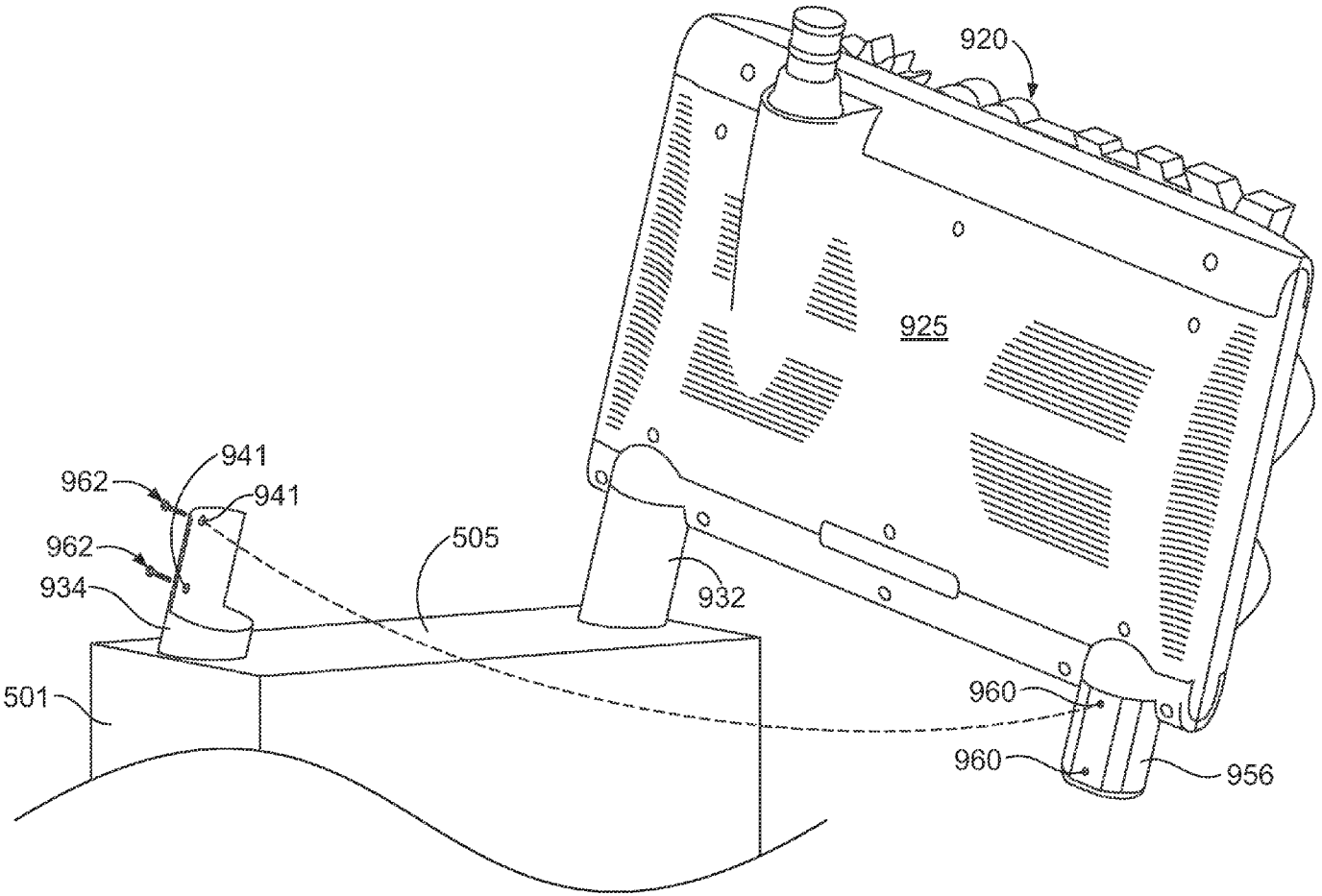
FIG. 9 is a perspective-view illustration of a display mounting assembly suspending the signage display in a representative mounting/dismounting position.

FIG. 9 provides an exemplary mounting assembly for mounting a signage display 920 to a top surface 505 of the supporting structure 501. In FIG. 9, the signage display 920 is configured as a pivotably mounted display screen connected via two angled cylindrical support sleeves 932, 934 that support the signage display 920 by interfacing with a first swing pole (internal to the support sleeve 932) and a second swing pole 956. The signage display 920 includes a housing 925 that houses and/or supports a display device (on a reverse side of the signage display 920 as positioned in FIG. 9). While the signage display 920 is shown for exemplary purposes, implementations may incorporate any of the signage displays (e.g. 520, 720, 820) previously described in connection with the mounting assembly that is described in connection with FIG. 9.

The mounting/support assembly shown in FIG. 9 optimizes the ergonomics associated with mounting and dismounting a signage display 920 by pivotably supporting the signage display 920 such that one side thereof can be readily swung from over the top of the supporting structure 501 to overhanging the supporting structure 501, and back, without requiring a technician to manage the bulk and weight of the signage display 920. As seen in FIG. 9, the mounting assembly pivotably mounts the signage display 920 to a top portion of the supporting structure 501. The mounting assembly, and thus the signage display 920, are selectively repositionable (e.g., can be swung) between a first "operational" position, and a second "maintenance" position, which is the position illustrated for explanatory purposes in FIG. 9. When in the first position, the entire signage display 920 is positioned over a top portion of the supporting structure 501, sitting generally upright. While in the first position, the signage display 920 can be rigidly attached to the supporting structure 501. By way of non-limiting example, the second swing pole 956 can include threaded slots 960, each of which receives a complementary threaded fastener 962 that is fed through a corresponding hole 941 in the second support sleeve 934, thereby locking the signage display 920 in the first position. In addition, when the signage display 920 is in the first position, it is functionally oriented for normal operation thereof. That is, the signage display 920 is situated such that the display device (e.g. LCD, plasma, or LED display panel) is visible to players and operational for use during normal operation of a gaming terminal (such as the gaming terminal 710 shown in FIG. 7) positioned in front of the supporting structure 501.

When the mounting assembly and, thus, the signage display 90 are in the second position, as seen in FIG. 9, a side of the signage display 920 extends over the front of the supporting structure 501. When positioned near a rear side of the gaming terminal, the signage display 920 extends over the front of the gaming terminal (i.e. the side of the gaming terminal 710 with the terminal display 714). When so situated, the signage display 920 is generally perpendicular to the width of the supporting structure 501. By swinging the signage display 920 and mounting assembly to the second position, the center of gravity of the signage display 920 is relocated to facilitate removal thereof from the supporting structure 501. In an exemplary configuration, the first sleeve 932 carries the entire weight of the signage display 920 when swung from the first to the second position, and back. The necessary structural integrity to transmit the weight of the signage display 920 through the first swing pole (shown internal to the first support sleeve 932) and to the supporting structure 501 can be provided by an L-shaped support arm extending through the first support sleeve 932, such as is disclosed by way of example in U.S. patent application Ser. No. 13/027,389, filed Feb. 15, 2011, titled "Display Mounting Assemblies and Gaming Terminals with Mounting Assemblies for Display Devices," which is incorporated herein by reference in its entirety.

The supporting structure 501 disclosed herein advantageously allows for modular design and re-configuration of gaming systems at a gaming venue. By incorporating reusable aspects such as the supporting structure 501 that can be employed with various configurations of signage displays (520, 720, 820, 920), an operator of a gaming venue has increased flexibility in designing and re-designing configurations for the gaming venue according to dynamic demands of customers.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system, comprising:

a first gaming terminal for playing a first wagering game, the first gaming terminal including a base cabinet, an input device for receiving inputs from a player to play the first wagering game, and a terminal display for displaying information related to the first wagering game;

a supporting structure including an enclosure having two side walls and a width dimension between the two side walls, the supporting structure in contact with a floor and positioned adjacent to the first gaming terminal, the width dimension of the supporting structure being substantially identical to the width of the base cabinet of the first gaming terminal and the two side walls being generally aligned with respective side walls of the base cabinet;

a signage display including a display device for displaying first information related to the first wagering game, the signage display being mounted on the supporting structure such that the display device is immediately above the base cabinet of the first gaming terminal, the signage display and the supporting structure being free of rigid physical attachment to the first gaming terminal, wherein the first gaming terminal is removable from the adjacent position to the supporting structure; and wherein the signage display displays second information related to a second wagering game on the display device when the first gaming terminal is removed and a second gaming terminal is positioned adjacent to the support structure, the second gaming terminal for playing the second wagering game and including a second base cabinet having the same width of the base cabinet of the first gaming terminal and side walls being generally aligned with respective side walls of the supporting structure, wherein the signage display and the supporting structure are free of rigid physical attachment to the second gaming terminal.

2. The gaming system of claim 1, wherein the signage display includes a housing for mounting the display device and for enclosing one or more electrical cables providing electrical input signals to the display device.

3. The gaming system of claim 2, wherein the enclosure and the housing each include matched ports adapted to allow the one or more electrical cables to pass between the supporting structure and the housing.

4. The gaming system of claim 2, wherein the one or more electrical cables include a power cable for delivering power to the display device and a media cable for delivering a video input signal to the display device.

5. The gaming system of claim 1, wherein the enclosure includes:

a modular removable panel for providing airflow through the enclosure and for connecting to an adjacent similarly configured supporting structure, and a port near a top of the enclosure aligned with an opening in a bottom of the signage display for allowing electrical cables to pass between the supporting structure and the display device.

6. The gaming system of claim 1, wherein the supporting structure includes a universal mounting base for supporting the signage display, and the signage display is adapted to be removably coupled to the universal mounting base.

7. The gaming system of claim 6, wherein at least one electrical connector is integrated with the universal mounting base.

8. The gaming system of claim 7, wherein the at least one electrical connector is configured to automatically electrically connect the signage display in response to the signage display being mounted to the universal mounting base.

9. The gaming system of claim 1, wherein the display device of the signage display comprises a single display device associated with at least one additional gaming terminal adjacent to the gaming terminal, and wherein the supporting structure is further configured to couple to at least one additional supporting structure to jointly support the signage display such that the signage display is immediately above the base cabinet of the gaming terminal and a base cabinet of the at least one additional gaming terminal.

10. The gaming system of claim 1, wherein the supporting structure includes mounting structures adapted to removably couple the supporting structure to an adjacent supporting structure, the mounting structures being one of a group consisting of clipping components, snapping components, sliding components, and screwing components.

11. The gaming system of claim 1, wherein the supporting structure includes one or more speakers for producing sounds related to the wagering game.

12. The gaming system of claim 1, wherein the signage display is configured to abut a top surface of the base cabinet of the gaming terminal.

13. The gaming system of claim 1, wherein the supporting structure further includes a riser adapted to raise the height of the enclosure of the supporting structure, the riser being positioned between the floor and the enclosure and being free of physical attachment to the gaming terminal.

14. A gaming system, comprising:

a first gaming terminal for playing a first wagering game, the first gaming terminal including a first base cabinet, a first input device for receiving inputs to play the first wagering game, and a first terminal display for displaying information related to the first wagering game;

a second gaming terminal for playing a second wagering game, the second gaming terminal including a second base cabinet, a second input device for receiving inputs to play the second wagering game, and a second terminal display for displaying information related to the second wagering game;

a signage display being free of rigid physical attachment to the first or the second gaming terminals and including:

a first display device for displaying, on a first side of the signage display, first information related to the first wagering game played on the first gaming terminal;

a second display device for displaying, on a second side of the signage display opposite the first side, second information related to the second wagering game played on the second gaming terminal;

a supporting structure adapted for being positioned between the first and the second gaming terminals for supporting the signage display such that the first display device is immediately above the first base cabinet of the first gaming terminal and the second display device is immediately above the second base cabinet of the second gaming terminal, the supporting structure including an enclosure having two side walls and a width dimension between the two side walls, the supporting structure in contact with a floor, and wherein the width dimension of the supporting structure is substantially identical to the width of the first base cabinet of the first gaming terminal and the two side walls being generally aligned with respective side walls of the first base cabinet and being free of rigid physical attachment to the first or the second gaming terminals; and wherein the first gaming terminal is removable from the position relative to the supporting structure; and wherein the signage display displays third information related to a third wagering game on the first display device when the first gaming terminal is removed and a third gaming terminal is positioned in place of the first gaming terminal, the third gaming terminal for playing the third wagering game and including a third base cabinet having the same width of the base cabinet of the first gaming terminal and side walls being generally aligned with respective side walls of the supporting structure, wherein the signage display and the supporting structure are free of rigid physical attachment to the third gaming terminal.

15. The gaming system of claim 14, wherein the signage display further includes a housing for mounting the first display device and the second display device, and for enclosing electrical cables providing electrical input signals to the first and the second display devices.

16. The gaming system of claim 14, wherein the enclosure is adapted for being placed between a back side of the first gaming terminal and a back side of the second gaming terminal.

17. The gaming system of claim 16, wherein the enclosure includes:

a modular removable panel for providing airflow through the enclosure and for connecting to an adjacent similarly configured supporting structure, and a port near a top of the enclosure aligned with an opening in a bottom of the signage display for allowing electrical cables to pass between the supporting structure and the display device.

18. The gaming system of claim 14, wherein the-enclosure has an electrical connector for conveying electrical input signals to the first and the second display devices, the electrical connector being accessible from an exterior of the enclosure.

19. The signage display of claim 14, wherein the supporting structure includes a universal mounting base for supporting the signage display, and the signage display is adapted to be removably coupled to the universal mounting base.

20. The gaming system of claim 14, wherein the supporting structure includes one or more speakers for producing sounds related to the first or the second wagering game.

21. A gaming system, comprising:

a first gaming terminal for playing a first wagering game, the first gaming terminal including a first base cabinet, a first input device for receiving inputs to play the first wagering game, and a first terminal display for displaying information related to the first wagering game;

a second gaming terminal for playing a second wagering game, the second gaming terminal including a second base cabinet, a second input device for receiving inputs to play the second wagering game, and a second terminal display for displaying information related to the second wagering game, the first gaming terminal and the second gaming terminal being positioned such that a back side of the first base cabinet of the first gaming terminal is facing a back side of the second base cabinet of the second gaming terminal; and a signage display including:

a first display device for displaying, on a first side of the signage display, first information related to the first wagering game played on the first gaming terminal;

a second display device for displaying, on a second side of the signage display opposite the first side, second information related to the second wagering game played on the second gaming terminal;

a supporting structure for supporting the signage display such that the first display device is immediately above the first base cabinet of the first gaming terminal and the second display device is immediately above the second base cabinet of the second gaming terminal, the signage display and the supporting structure being free of rigid physical attachment to the first or the second gaming terminals, the supporting structure including an enclosure having two side walls and a width dimension between the two side walls, the supporting structure in contact with a floor, and wherein the width dimension of the supporting structure is substantially identical to the width of the base cabinets the gaming terminals and the two side walls being generally aligned with respective side walls of the base cabinets and adapted for being positioned between the back side of the first base cabinet and the back side of the second base cabinet; and wherein the first gaming terminal is removable from the position relative to the supporting structure; and wherein the signage display displays third information related to a third wagering game on the first display device when the first gaming terminal is removed and a third gaming terminal is positioned in place of the first gaming terminal, the third gaming terminal for playing the third wagering game and including a third base cabinet having the same width of the base cabinet of the first gaming terminal and side walls being generally aligned with respective side walls of the supporting structure, wherein the signage display and the supporting structure are free of rigid physical attachment to the third gaming terminal.

22. The gaming system of claim 21, wherein the enclosure has an electrical connector accessible from an exterior of the enclosure.

23. The gaming system of claim 21, wherein the enclosure includes:

a modular removable panel for providing airflow through the enclosure and for connecting to an adjacent similarly configured supporting structure, and a port near a top of the enclosure aligned with an opening in a bottom of the signage display for allowing electrical cables to pass between the supporting structure and the first or the second display device.

24. The gaming system of claim 21, wherein the supporting structure includes a universal mounting base for supporting the signage display, and the signage display is adapted for being removably coupled to the universal mounting base.

25. The gaming system of claim 1, wherein the supporting structure includes a media controller that generates media signals indicative of visual or audio effects to be conveyed to the display device of the signage display.

26. The gaming system of claim 1, wherein the display device displays a bonus feature associated with the first wagering game.

* * * * *